US006501213B2

(12) United States Patent
Doty

(10) Patent No.: US 6,501,213 B2
(45) Date of Patent: Dec. 31, 2002

(54) APPARATUS AND METHOD FOR TERMINATING CROSSWIRES ON A TENSION FOCUS MASK

(75) Inventor: James Edward Doty, Skillman, NJ (US)

(73) Assignee: Thomson Licensing S. A., Boulogne Cedex (FR)

( * ) Notice: Subject to any disclaimer, the term of this patent is extended or adjusted under 35 U.S.C. 154(b) by 168 days.

(21) Appl. No.: 09/747,229

(22) Filed: Dec. 22, 2000

(65) Prior Publication Data

US 2002/0079806 A1 Jun. 27, 2002

(51) Int. Cl.[7] ..... H01J 29/80; H01J 9/46
(52) U.S. Cl. ..... 313/402; 313/407; 445/30
(58) Field of Search ..... 313/402, 407, 313/403, 408, 409, 414; 445/30, 66

(56) References Cited

U.S. PATENT DOCUMENTS 5,646,478 A * 7/1997 Nosker et al. ..... 313/402
2002/0079808 A1 * 6/2002 LaPeruta et al. ..... 313/407
2002/0081933 A1 * 6/2002 Wilbur ..... 445/30

* cited by examiner

*Primary Examiner*—Don Wong
*Assistant Examiner*—Chuc Tran
(74) *Attorney, Agent, or Firm*—Joseph S. Tripoli; Joseph J. Laks; Carlos M. Herrera

(57) ABSTRACT

An apparatus and method for terminating crosswires on a tension focus mask. The apparatus includes a busbar support rail aligned with a busbar attached by a set of spacers and busbar support clips, a termination assembly and a set of termination spring clips. The method includes aligning the busbar support rail with the busbar, attaching busbar support clips to the busbar, affixing spacers to a side of the busbar and then placing a termination strip along the side of the spacer. After all the elements have been aligned, crosswires are drawn across the top of the busbar and attached to the termination strip. An electrical adhesive is applied over the busbar top and allowed to cure. After the electrical adhesive cures, the crosswires between the busbar and the termination strip are cut so as to provide electrical isolation.

17 Claims, 2 Drawing Sheets

APPARATUS AND METHOD FOR TERMINATING CROSSWIRES ON A TENSION FOCUS MASK

The invention generally relates to the application of crosswires to a tension focus mask for use in color picture tubes and, more particularly, a method and apparatus of terminating a crosswire to a busbar while maintaining tension on the focus mask.

BACKGROUND OF THE INVENTION

A color picture tube includes an electron gun for forming and directing three electron beams to a screen of the tube. The screen is located on the inner surface of the faceplate of the tube and is made up of an array of elements of three different color-emitting phosphors. An aperture mask, which may be either a shadow mask or a tension mask, is interposed between the electron gun and the screen to permit each electron beam to strike only the phosphor elements associated with that beam. A shadow mask is a thin sheet of metal, such as steel, that is contoured to somewhat parallel the inner surface of the tube faceplate. A shadow mask may be either domed or tensioned. A type of tension mask, called a tension focus mask, comprises two sets of conductive elements that are perpendicular to each other and separated by an insulator. Two different voltages are applied to the two sets of elements to create quadropole focusing lenses in each of the mask opening, which form a focus mask. The mask openings are defined by the rectangular space between adjacent vertical lines and adjacent horizontal lines. Generally, in a tension focus mask, a vertical set of conductive lines or strands is under tension and a set of horizontal conductive elements sometimes known as crosswires overlies the strands.

In cathode ray tubes containing tension focus masks, the spatial integrity of the strands and crosswires is critical. The crosswires and strands must not move from their respective positions during tube operation or during the fabrication process of the mask assemblies, the matrix or the screening processes. Any such motion of the crosswires could impact the mask strands causing electron beams to misregister or phosphor to matrix misregister. It is therefore desirable that the mask structural elements, especially those used to terminate the crosswires, must be rigid.

SUMMARY OF THE INVENTION

The present invention provides an apparatus and method for attaching crosswires to a busbar in a tension focus mask. The apparatus includes a set of elements aligned next to each other and held together by a set of clips. The aligned elements include a busbar support rail that is placed adjacent to a glass busbar. The glass busbar is held against the busbar support rail by busbar clips. A spacer assembly is then added, and a termination strip is put against the spacer assembly. A set of termination strip clips hold the termination strip against the spacer and help to keep all of the elements together. After the elements are aligned and held together by the clips, crosswires from a tension mask are laid across the top of the busbar past the spacer assembly and onto the termination strip. The wires are affixed to the termination strip using a fast-curing adhesive or weld after which a non-structural electrical adhesive is laid across the top of the busbar adhering the crosswires to the top of the busbar. The assembly is then placed in an oven where the non-structural electrical adhesive dries or cures. After the oven cycle, the assembly is removed and allowed to cool after which the crosswires that attach to the termination strip are then removed to provide electrical isolation.

DETAILED DESCRIPTION

Figure 1:
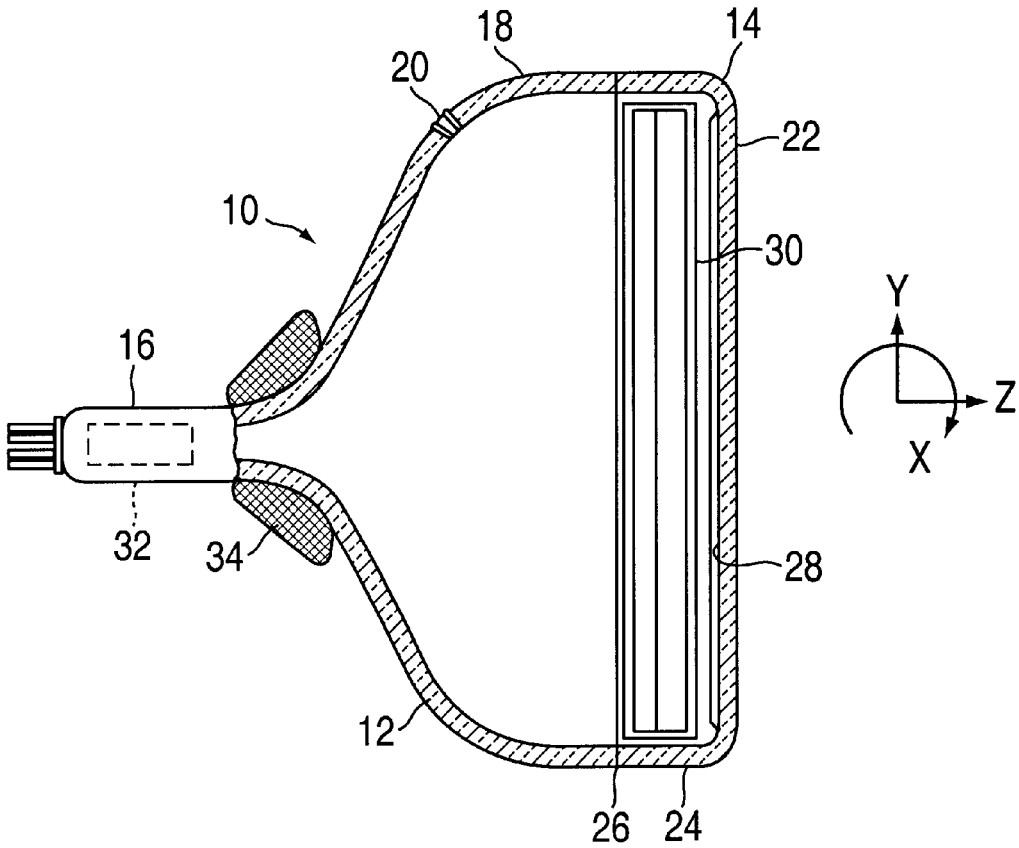
FIG. 1 is a side view, partially in axial section, of a color picture tube, including a tension focus mask assembly according to the present invention.

FIG. 1 shows a cathode ray tube 10 having a glass envelope 12 comprises a rectangular face plate panel 14 and a tubular neck 16 connected by a rectangular funnel 18. The funnel 18 has an internal conductive coating (not shown) that extends from an anode button 20 to a neck 16. The panel 14 comprises a viewing face plate 22 and a peripheral flange or sidewall 24 that is sealed to the funnel 18 by a glass frit 26. A three-color phosphor screen 28 is carried by the inner surface of the face plate 22. The screen 28 is a line screen with the phosphor lines arranged in triads, each triad including a phosphor line of each of the three colors. A tension focus mask 30 is removably mounted in a predetermined spaced relation to the screen 28. An electron gun 32 (schematically shown by the dashed lines in FIG. 1) is centrally mounted within the neck 16 to generate three in-line electron beams, a center beam and two side beams, along convergent paths through the mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields which cause the beams to scan horizontally and vertically in a rectangular raster over the screen 28.

Figure 2:
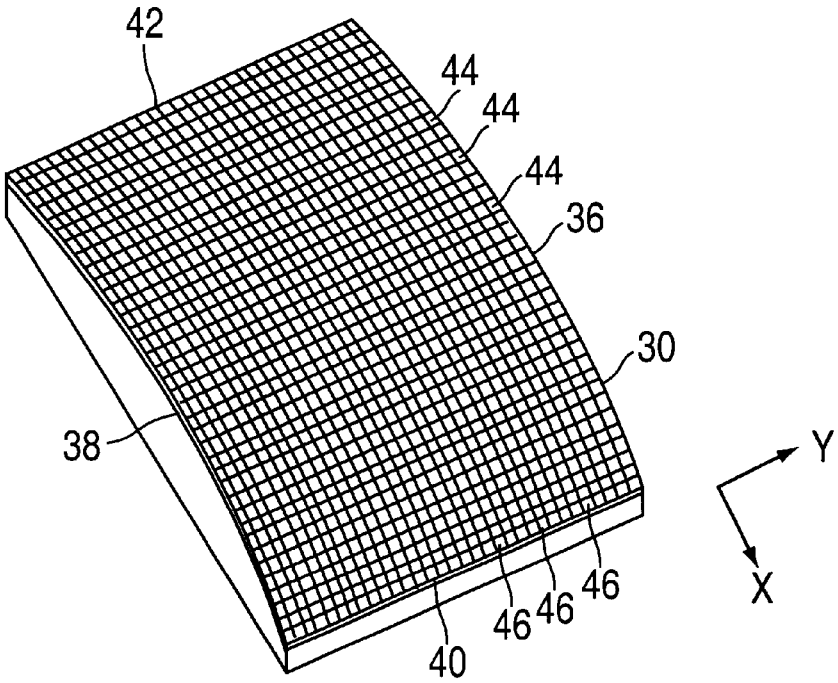
FIG. 2 is a perspective view of the tension focus mask assembly of FIG. 1.

The tension mask 30, shown in greater detail in FIG. 2, includes two longs sides 36 and 38 and two short sides 540 and 42. The two long sides 36 and 38 of the mask parallel a central major axis, x, of the tube. The tension mask 30 includes two sets of conductive lines: strands 44 that are parallel to the central minor axis y and to each other; and crosswires 46, that are parallel to the central major axis x and to each other. In a preferred embodiment, the strands 44 are flat strips that extend vertically, having a width of about 13 mils and a thickness of approximately 2 mils, and the wires 46 have a round cross section, having a diameter of about 1 mil and extend horizontally. In the completed mask, the strands and wires are separated from each other by suitable insulators such as FOX.

Figure 3:
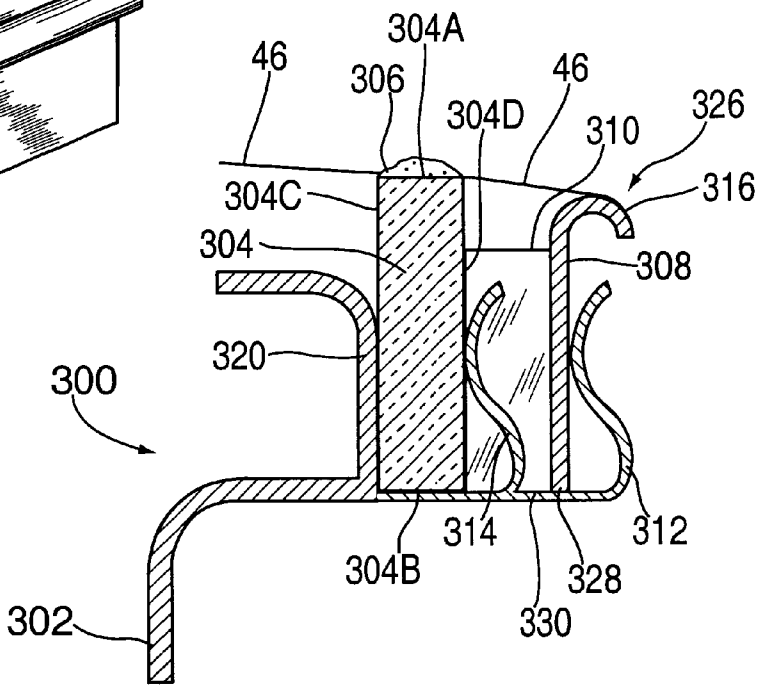
FIG. 3 is a side view, cross-sectional, of the apparatus for terminating crosswires.
Figure 4:
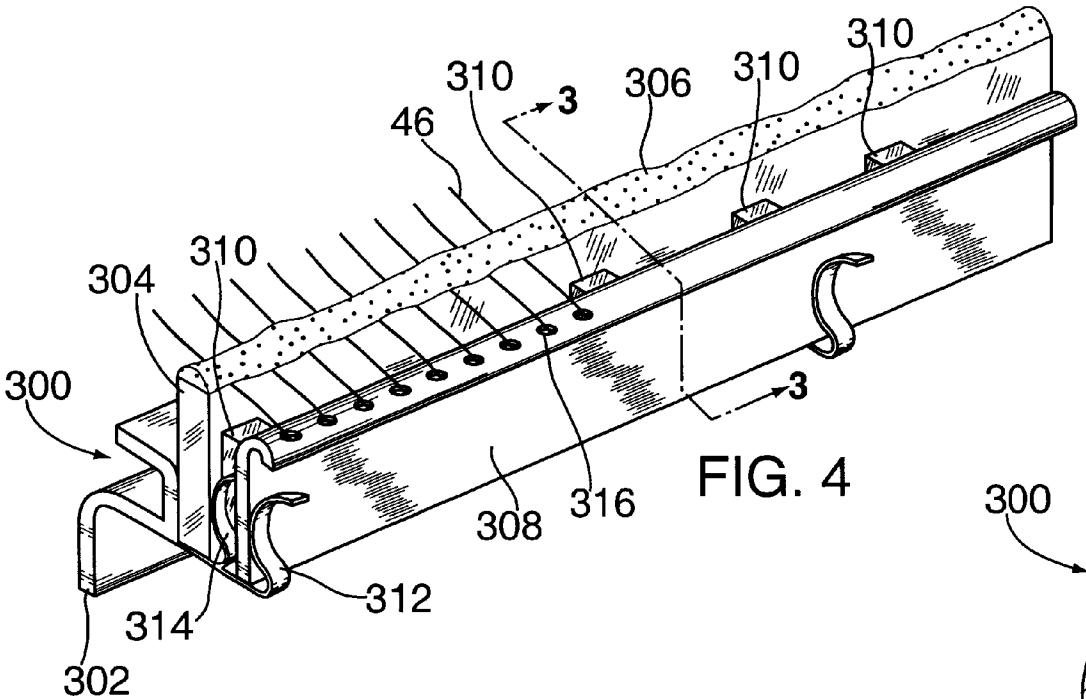
FIG. 4 is a perspective view of the apparatus for terminating crosswires.

FIG. 3 depicts a side view, cross section, of the apparatus 300 for terminating crosswires 46, and FIG. 4 depicts a perspective view of the apparatus 300. To best understand the invention, the reader should simultaneously refer to both FIGS. 3 and 4. The first element is a busbar support rail 302. The busbar support rail 302 is formed in a modified inverted "S" shape and mounted vertically, while a portion of the busbar support rail 302 projects horizontally. The busbar support rail 302 may be formed from any suitable material and fabricated by any method, including but not limited to, casting, extrusion, bending or injection molding. The busbar support rail 302 projects linearly a distance sufficient to support the entire length of a busbar 304. The rail 302 provides enough stability to prevent the busbar 304 from being pulled inward toward the center of the mask assembly (not shown) from the force being exerted on it by the tensioned crosswires 46 of the mask assembly (not shown).

A glass busbar 304 having a top 304A, bottom 304B and two respective sides 304C, 304D is aligned such that the exterior wall of the busbar 304 is in contact with the vertical portion 320 of the busbar support rail 302. The busbar 304 projects linearly to at least the length of the busbar support rail 302. The busbars 304 are generally formed of an insulating material, the coating providing an electrically conductive property.

Another property of the busbar 304 is rigidity. Rigidity applies to the deformable nature of the busbar 304 during manufacture of the CRT 10 and in use. The busbar 304 is formed to be rigid so as to prevent beam misregister during use of the CRT 10. For the purpose of preventing beam misregistration, the beam deflection from the electron gun 32 to the screen 28 can be no more than 2–4 mils depending on the screen 28 size.

A set of busbar clips 314 are attached to the outside wall 304D of the busbar 304 so as to place pressure on the busbar 304, thus keeping the busbar 304 in contact with the vertical support of the busbar support rail 302. The busbar clip 314 is formed in the shape of an "S", the tail portion 322 of the "S" extending under the busbar 304 and being secured to the busbar support rail 302. The busbar clip 314 uses spring pressure to apply tension to the busbar 304.

A spacer assembly 310 is then placed in contact with the side 304D of the busbar 304. The spacer assembly 310 is in direct contact with the busbar 304 and provides a space between the busbar 304 and a termination strip 308. The distance between the busbar support rail 302 and the termination strip 308 is maintained by the spacer assembly 310. This distance is maintained even under tensioned pulling force. As such, the busbar 304 will not come in contact with the termination strip 308.

Termination strip 308 is about the same length as the busbar 304. The termination strip 308 is formed such that it has a top 326, bottom 328 and respective thickness, and has a formed feature 316 disposed upon its top 326 that provides an area of attachment for crosswires 46. The attachment area of the termination strip 308 is formed of a material that can either be welded or accepts an adhesive. If an adhesive is used, it must be a high temperature, fast-curing structural adhesive such as KASIL (potassium silicate). The termination strip 308 may be formed from any suitable material such as steel and fabricated by any method, including but not limited to, casting, extrusion, bending or injection molding.

A set of termination strip clips 312 are positioned to exert force against the termination strip 308, the force is directed toward the termination strip 308, and in turn applied to the rest of the assembly 300. The termination strip clip 312 uses spring tension to affix and apply pressure to the termination strip 308. The termination strip clip 312 is similar to that of the busbar clip 314 being formed in the shape of an "S" and having the tail portion 330 of the "S" disposed under the spacer assembly 310, the busbar 304, and terminating in the busbar support rail 302.

Once all of the elements have been properly aligned and assembled, a plurality of crosswires 46 are laid across the top of the busbar 304 and over the termination strip 308. At this point the crosswires 46 are welded or glued using a fast-curing high temperature adhesive 316 such as KASIL to the top of the termination strip 308, thus affixing the crosswire 46 and maintaining tension. The non-structural electrical adhesive 306 will only cure when exposed to high temperatures in an oven cycle. This non-structural electrical adhesive 306 provides electrical connection or conductivity for applying the focus voltage. An example of the aforementioned non-structural electrical adhesive 306 is ruthenium glass.

After curing, the section of crosswires 46 between the glass busbar 304 and the termination strip 308 is removed to provide electrical isolation. Removal may be accomplished by any method such as cutting, so that a gap is left between the crosswires 46 on the termination strip 308 and the crosswires 46 on the busbar 304.

As the embodiments that incorporate the teachings of the present invention have been shown and described in detail, those skilled in the art can readily devise many other varied embodiments that still incorporate these teachings without departing from the spirit of the invention.

What is claimed is:

1. An tensioned focus mask in a cathode ray tube, comprising:

a plurality of crosswires;

a busbar for affixing thereto each crosswire at a first position along a length dimension of said crosswire; and a termination strip separated from said busbar by a distance for affixing thereto each crosswire at a different, second position along the length dimension of said crosswire.

2. The apparatus of claim 1, wherein the busbar is separated from termination strip by a spacer assembly.

3. The apparatus of claim 1, wherein busbar is positioned between the spacer assembly and a support rail.

4. The apparatus of claim 1, wherein the termination strip is held in place by a set of termination strip spring clips.

5. The apparatus of claim 1, further comprising an adhesive for affixing each crosswire at said first position to said busbar.

6. The apparatus of claim 5 wherein the adhesive is a non-structural electrical adhesive.

7. The apparatus of claim 1 wherein the busbar is formed of glass.

8. A method of terminating crosswires on a tensioned focus mask, said method comprising:

(a) providing a busbar;

(b) aligning said busbar with a termination strip;

(c) affixing a plurality of crosswires of a tensioned focus mask to the termination strip;

(d) affixing the crosswires of a tensioned focus mask to the busbar;

(e) cutting the crosswires between the termination strip and the busbar.

9. The method as described in claim 8 further comprising the step of aligning the busbar with a busbar support rail.

10. The method as described in claim 8 further comprising the step of attaching a plurality of busbar support clips in order to prevent movement of busbar.

11. The method as described in claim 8 further comprising the step of attaching a plurality of spacers between the busbar and the termination strip.

12. The method as described in claim 8 further comprising the step of attaching a plurality of termination support clips to the termination strip.

13. The method as described in claim 8, further comprising the step of leveling the busbar with the busbar support rail, spacers and termination strip.

14. The method as described in claim 8 further comprising the step of sliding the busbar into the busbar tension clips.

15. The method as described in claim 8 further comprising the step of sliding the termination strip between the spacers and the termination strip clips.

16. The method as described in claim 8 further comprising the step of welding the crosswires to the termination strip.

17. The method as described in claim 8 further comprising the step of applying a non-structural adhesive across a top of the busbar.

* * * * *